US009371692B2

(12) United States Patent
Eddison

(10) Patent No.: US 9,371,692 B2
(45) Date of Patent: Jun. 21, 2016

(54) DOWNHOLE TOOL

(75) Inventor: Alan Martyn Eddison, York (GB)

(73) Assignee: NOV DOWNHOLE EURASIA LIMITED, Stonehouse, Gloucestershire (GB)

( * ) Notice: Subject to any disclaimer, the term of this patent is extended or adjusted under 35 U.S.C. 154(b) by 1050 days.

(21) Appl. No.: 13/355,331

(22) Filed: Jan. 20, 2012

(65) Prior Publication Data

US 2012/0186878 A1 Jul. 26, 2012

(30) Foreign Application Priority Data

Jan. 21, 2011 (GB) ..... 1101033.7

(51) Int. Cl.
*E21B 4/14* (2006.01)

(52) U.S. Cl.
CPC ..... *E21B 4/14* (2013.01)

(58) Field of Classification Search
CPC ..... E21B 4/14
USPC ..... 175/296
See application file for complete search history.

(56) References Cited

U.S. PATENT DOCUMENTS

| | | | | |
|---|---|---|---|---|
| 1,132,063 | A | 3/1915 | Bardeen | |
| 2,028,407 | A | 3/1936 | Moineau | |
| 2,250,912 | A | 7/1941 | Hudson et al. | |
| 2,672,847 | A | 3/1954 | Bergmann | |
| 2,738,956 | A | 3/1956 | Bielstein | |
| 2,743,083 | A | 4/1956 | Zublin | |
| 2,780,438 | A | 2/1957 | Bielstein | |
| 3,216,514 | A | 11/1965 | Nelson | |
| 3,270,822 | A * | 9/1966 | Cleary | 173/137 |
| 4,080,115 | A | 3/1978 | Sims et al. | |
| 4,103,591 | A | 8/1978 | Reiersdal | |
| 4,512,417 | A | 4/1985 | Kurt | |
| 5,139,400 | A | 8/1992 | Ide | |
| 5,715,897 | A | 2/1998 | Gustafsson | |
| 6,279,670 | B1 * | 8/2001 | Eddison et al. | 175/107 |
| 6,431,294 | B1 | 8/2002 | Eddison et al. | |

(Continued)

FOREIGN PATENT DOCUMENTS

| | | |
|---|---|---|
| CA | 2178813 | 12/2005 |
| GB | 2108594 | 5/1983 |

(Continued)

OTHER PUBLICATIONS

Search Report dated Jan. 3, 2012 for related United Kingdom Patent Application No. GB1101033.7.

(Continued)

*Primary Examiner* — Jennifer H Gay
*Assistant Examiner* — George Gray
(74) *Attorney, Agent, or Firm* — Conley Rose, P.C.

(57) ABSTRACT

A downhole tool including a fluid-actuated piston and a motor-driven valve. The fluid-actuated piston is operatively associated with a reciprocating mass. The motor-driven valve is configured to supply actuating fluid sequentially to drive the piston downwards and upwards.

A method of reciprocating a mass in a downhole tool. The method including cycling a motor-driven valve between a first configuration and a second configuration. In the first configuration actuating fluid pressure drives a piston associated with the mass downwards. In the second configuration actuating fluid pressure drives the piston upwards.

47 Claims, 9 Drawing Sheets

(56) References Cited

U.S. PATENT DOCUMENTS

| | | | | |
|---|---|---|---|---|
| 6,439,318 | B1 | 8/2002 | Eddison et al. | |
| 6,508,317 | B2 | 1/2003 | Eddison et al. | |
| 6,588,518 | B2 | 7/2003 | Eddison | |
| 7,461,706 | B2 | 12/2008 | Eddison | |
| 7,823,663 | B2 | 11/2010 | Eddison | |
| 8,167,051 | B2 | 5/2012 | Eddison et al. | |
| 2004/0222021 | A1* | 11/2004 | Trevas | E21B 4/14 175/57 |
| 2009/0183919 | A1 | 7/2009 | Hall et al. | |
| 2009/0183920 | A1 | 7/2009 | Hall et al. | |
| 2010/0212912 | A1 | 8/2010 | Eddison et al. | |
| 2012/0186878 | A1 | 7/2012 | Eddison | |
| 2012/0312549 | A1 | 12/2012 | Eddison | |

FOREIGN PATENT DOCUMENTS

| | | |
|---|---|---|
| GB | 2108594 | 2/2007 |
| GB | 2246803 | 2/2007 |
| WO | 2012138383 | 10/2012 |
| WO | 2014089457 | 6/2014 |

OTHER PUBLICATIONS

GB Search Report dated Mar. 14, 2012 for counterpart GB Application No. GB1201054.2, pp. 1-5.

Mar. 15, 2012 Search Report under Section 17 from UK counterpart application No. GB1201054.2 (5 pages).

* cited by examiner

DOWNHOLE TOOL

CROSS-REFERENCE TO RELATED APPLICATION

This application claims the benefit of GB Patent Application No. 1101033.7, filed on Jan. 21, 2011, the entire contents of which are hereby incorporated by reference.

FIELD OF THE INVENTION

This invention relates to a downhole tool. In particular, but not exclusively, the invention relates to a tool incorporating a reciprocating mass. The tool may be a reciprocating mass percussion tool. Other aspects of the invention relate to a drill bit. The drill bit may be adapted for use in combination with a percussion tool.

BACKGROUND OF THE INVENTION

In the oil and gas exploration and production industry, bores of ever increasing length are drilled to access subsurface hydrocarbon-bearing formations. For drilling through relatively hard rock it is known to incorporate hammer-drilling apparatus, such as the tool which has been supplied by the applicant under the ANDERHAMMER™ trade mark. A hammer-drilling apparatus is also described in applicant's U.S. Pat. No. 6,431,294, the disclosure of which is incorporated herein in its entirety. The ANDERHAMMER™ tool includes a reciprocating mass which is driven by fluid pressure to impact on an anvil coupled to a drill bit. The mass incorporates a piston which is cyclically exposed to drilling fluid pressure by operation of a rotating valve arrangement driven by a positive displacement motor. With the valve in one position, an upper face of the piston is exposed to upstream drilling fluid pressure and is urged downwards, into contact with the anvil. As the valve is rotated to a second position the drilling fluid is directed to bypass the piston, allowing a spring to return the mass and piston to an initial position. Use of the tool when drilling in hard rock, such as granite, has resulted in increased rates of penetration when compared to conventional drilling methods. Another reciprocating mass drilling tool is described in applicant's U.S. Pat. No. 7,461,706, the disclosure of which is incorporated herein in its entirety.

Other arrangements which may be useful in drilling are disclosed in applicant's U.S. Pat. Nos. 6,279,670, 6,508,317, 6,588,518, 6,439,318, the entire contents of which are incorporated herein in their entirety.

SUMMARY OF THE INVENTION

According to the present invention there is provided a downhole tool comprising:

a fluid-actuated piston operatively associated with a reciprocating mass; and a motor-driven valve configured to supply actuating fluid sequentially to drive the piston downwards and upwards.

The invention also relates to a method of reciprocating a mass in a downhole tool, the method comprising cycling a motor-driven valve between a first configuration in which actuating fluid pressure drives a piston associated with the mass downwards and a second configuration in which actuating fluid pressure drives the piston upwards.

Embodiments of the invention may thus provide for movement of the piston in both directions under the influence of the actuating fluid. The piston may be linked to a reciprocating mass such that the actuating fluid also moves the mass in both directions. Thus, embodiments of the invention facilitate operation of reciprocating mass tools without, or at least reducing, reliance on a piston or mass return spring. This facilitates the provision of reliable and robust tools, and assists in avoiding the potential failure of return springs in the challenging environment of a downhole reciprocating mass tool.

These aspects of the invention utilize the tool actuating fluid to move the piston downwards, to urge the mass in the downwards direction, and also to move the piston upwards. The terms "upwards" and "downwards" as used herein refer to downhole applications, with downwards being towards the further or distal end of the hole or bore, typically the drilling direction, and are intended to encompass uses in horizontal or inclined bores. However, it will be apparent to those of skill in the art that embodiments of the invention may be used in a variety of orientations.

In these and other aspects of the invention the tool may be a reciprocating mass percussion tool. Various other variations and modifications to these and other aspects of the invention are described and discussed below. Unless specifically indicated, these variations and modifications may apply to all of the other aspects of the invention described herein.

The mass may be adapted to be operatively associated with a drill bit or other cutting structure, and may be operated to provide a hammer-drilling effect.

The tool may include a cylinder accommodating the piston, and the cylinder may include an upper and a lower chamber. When actuating fluid is directed to the upper chamber the piston may be urged downwards, and when actuating fluid is directed into the lower chamber the piston may be urged upwards. One or both of the chambers may include an exhaust port, and the port may be nozzled or otherwise configured to restrict flow through the port. The exhaust ports may be provided in the chamber walls. Alternatively, or in addition, an exhaust port, for example the upper chamber exhaust port, may be formed in the piston, and extend along the piston axis. In another embodiment an exhaust fluid path may be provided between a piston shaft and a cylinder end cap. One or both chambers may include inlet ports, one or both of which ports may be in fluid communication with the valve.

The tool may be configured such that communicating an actuating fluid pressure with an upper face of the piston produces a greater force on the piston than communicating a corresponding actuating fluid pressure with a lower face of the piston. This arrangement provides for a downwards power stroke and an upwards return stroke. The piston may be mounted on a piston shaft, and the shaft may be coupled to the mass. The shaft may extend through a lower piston chamber and reduce the area of piston exposed to actuating fluid pressure in the lower chamber. The lower chamber may feature a larger or otherwise less restrictive exhaust port.

The tool may be configured such that at least one piston stroke is damped, at least towards the end of the stroke. This may be achieved by appropriate valving, for example by providing an exhaust valve which is closed or restricted as the piston approaches the end of the stroke. Alternatively, or in addition, the diameter of the piston chamber may increase or be otherwise configured to permit fluid to bypass the piston as the piston approaches the end of the stroke.

The valve may include valve members which cooperate to open and close valve ports. The valve ports may be in fluid communication with inlet ports associated with respective piston chambers. The valve members may be relatively movable, for example by rotation, transverse movement, or a combination of both. One valve member may be fixed while the other valve member may be driven. The valve-driving motor may be a positive displacement motor, and in one embodiment a valve member is mounted to the rotor of a Moineau principle motor.

According to another aspect of the invention, there is provided a downhole tool including a fluid actuated piston operatively associated with a reciprocating mass, the piston having active and inactive configurations; and a motor-driven valve for controlling the supply of actuating fluid to the piston.

The invention also relates to a method of operating a downhole tool, the method including operating a motor-driven valve to control the supply of actuating fluid to a piston associated with a reciprocating mass; arranging the piston in an inactive configuration; and arranging the piston in an active configuration to reciprocate the mass.

Thus, the tool may be configured with the piston in the active configuration when it is desired to reciprocate the mass to provide, for example, agitation of the tool or a hammer effect on a drill bit. Alternatively, the piston may be configured in the inactive configuration, when reciprocation of the mass is not required. Thus, where the tool is provided as part of a system which it is desired to operate at some times without movement of the mass, undesirable conditions or effects associated with the movement of the mass, for example wear, agitation, vibration, pressure pulses or pressure losses, may be minimised or avoided.

Embodiments of the invention may be particularly useful in drilling applications, where the tool is provided as an element of a percussion drilling system. The ability to reconfigure the piston between active and inactive configurations is particularly useful when drilling through different rock types, for example layers of softer rock separated by layers of harder rock. In such a situation the piston may be arranged in the inactive configuration while drilling through the softer rock, such that there is no hammer-drilling effect. However, when harder rock is encountered, for example a stringer extending between softer formations, the piston may be arranged in the active configuration to provide a percussion effect. This compares favorably with current procedures and arrangements in which percussion drilling arrangements only have an active configuration. As a result, it is current practice to drill with conventional non-percussion drilling arrangements until harder rock is encountered. The drill string is then retrieved and a percussion drilling arrangement run into the bore and utilized until softer rock is encountered. The string is then retrieved again and the conventional drilling arrangement refitted. Clearly, the process of retrieving one drilling arrangement and then running in an alternative drilling arrangement is time-consuming and thus expensive. It is of course possible for operators to persevere with one drilling arrangement, however this often results in unacceptably slow rates of progression and decreased reliability.

The piston configuration may be controlled remotely from surface by any appropriate means. The configuration may be controlled, at least in part, by manipulation of fluid pressure or by mechanical forces applied to the tool, or by a combination thereof.

The tool may define a cylinder for accommodating the piston. The configuration of the piston may be determined by the relative positioning of the piston and the cylinder or a cylinder element. In the active configuration the piston may reciprocate between upper and lower positions and cooperate with fluid inlets and outlets in such a manner to maintain the reciprocation. In the inactive configuration the piston may be located such that actuating fluid may bypass the piston. For example, the piston may be located in a larger diameter section of the cylinder. Axial movement or positioning of the piston may be controlled by any appropriate means. The piston may be coupled, directly or indirectly, to a cam or other track. In one embodiment, the piston may be coupled to an axially movable bit, for example via a reciprocating mass. With the bit in one configuration the piston may be constrained to be in the active configuration and with the bit in another configuration the piston may be constrained to be in the inactive configuration. For example, with the bit in a retracted configuration the piston may be in the active configuration, and with the bit in an extended configuration the piston may be in the inactive configuration. The bit may be movable between different configurations by application of one or both of fluid pressure and weight. Thus, for example, the bit may be moved to the retracted configuration by applying weight to the bit, while the bit may be moved to the extended position by application of fluid pressure.

According to a further aspect of the invention there is provided a drill bit including a body; and a bit element mounted in the body, the bit having a first configuration adapted to generate a first pressure drop and a second configuration adapted to generate a higher second pressure drop.

The invention also relates to a drilling method including providing a drill bit and arranging a drill bit element in a bit body in a first configuration such that a first pressure drop is generated across the bit; and arranging the element in a second configuration such that a higher second pressure drop is generated across the bit.

In the first configuration the bit may be adapted for use in hammer drilling, typically through relatively hard rock, in which there is generally less requirement or advantage to providing high hydraulic horsepower at the bit. This lower pressure drop at the bit allows for other pressure drops, for example as induced by or required for operation of a hydraulic hammer, to be accommodated without any significant increase in standpipe pressure. In the second configuration the bit may be configured for drilling relatively soft rock, where it is generally advantageous to provide higher hydraulic horsepower at the bit to, for example, ensure adequate bit tooth and bottom-of-hole cleaning.

The different bit configurations may be achieved by a variety of different means. For example, the bit configuration may be determined by the relative positioning of the bit element and the bit body. Resistance to fluid flow across the bit may be determined by the bit element positioning, and moving the bit element between positions may open or close flow passages or ports. In one embodiment, the bit element is axially movable relative to the bit body, between extended and retracted positions. The higher second pressure drop may be associated with an extended bit element position, and the higher pressure drop may facilitate maintaining the extended bit element position, producing a fluid pressure element-extending force tending to resist the mechanical element-retracting force created by weight on bit. The bit element may define a piston area and the effective piston area may vary depending on the bit element position, for example the piston area may be greater when the bit element is extended, further facilitating maintaining the extended bit element position.

According to a still further aspect of the present invention, there is provided a hydraulically-actuated reciprocating mass percussion drilling tool including a percussion portion having a reciprocating mass and a fluid-actuated piston associated with the mass; and a drill bit associated with the mass, the tool having a first configuration in which the percussion portion is operative and a second configuration in which the percussion portion is inoperative.

The invention also relates to a drilling method including arranging a drilling tool in a first configuration in which a percussion portion having a mass and a fluid-actuated piston associated with the mass is operative to reciprocate the mass; and arranging the tool in a second configuration in which the percussion portion is inoperative.

In the first configuration the percussion portion may generate a first fluid pressure drop and in the second configuration the percussion may generate a lower second pressure drop.

The various aspects of the invention have utility independently of one another but may be provided in combination.

BRIEF DESCRIPTION OF THE DRAWINGS

These and other aspects of the invention will now be described, by way of example, with reference to the accompanying drawings, in which.

DETAILED DESCRIPTION OF THE DRAWINGS

Figure 1:
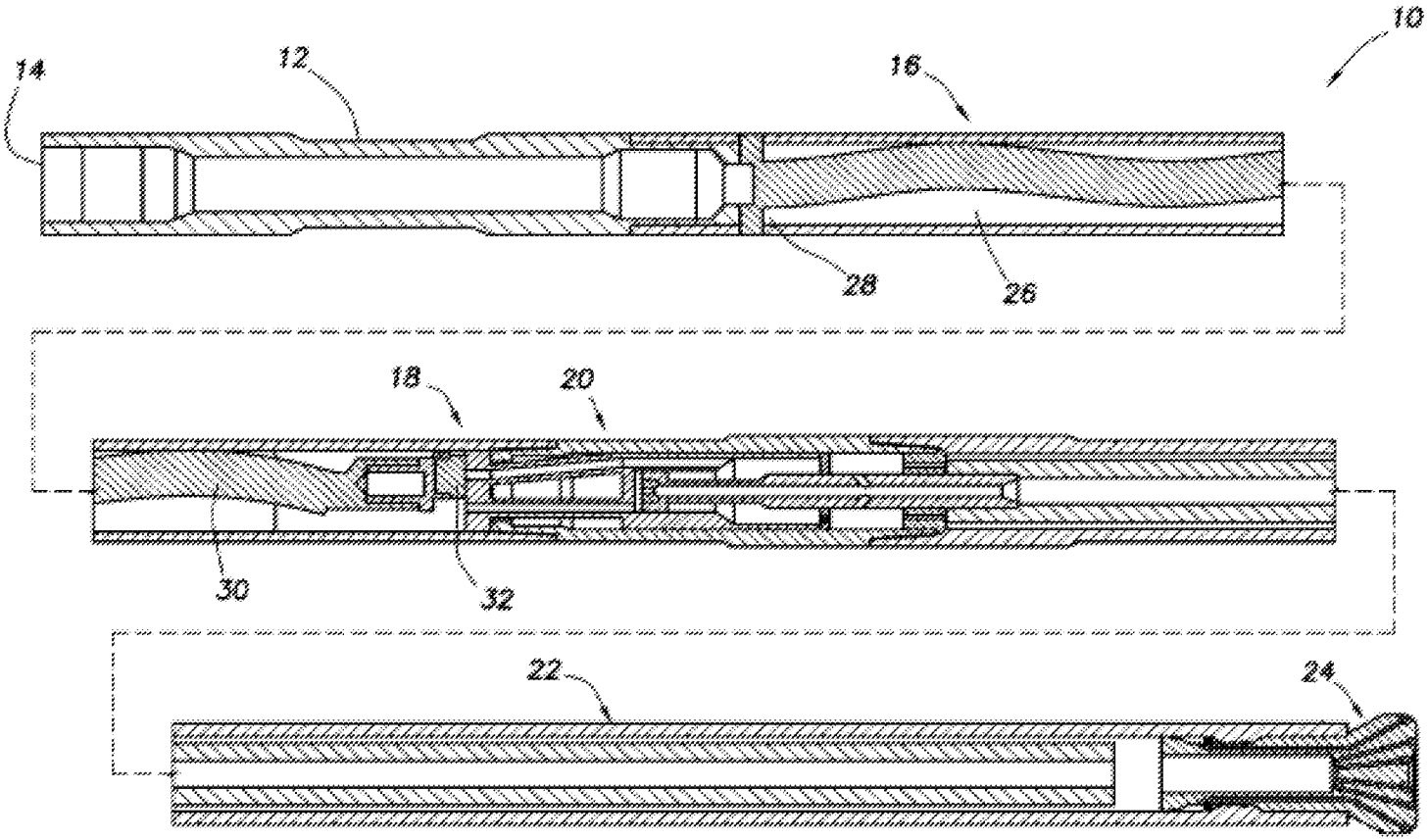
FIG. 1 is a sectional view of a reciprocating mass percussion hammer drilling tool in accordance with an embodiment of the present invention.

Reference is first made to FIG. 1 of the drawings, which is a sectional view of a reciprocating mass percussion hammer drilling tool 10 in accordance with an embodiment of the present invention. The tool 10 is intended to be mounted on the lower or distal end of a drill string and thus includes an appropriate sub 12 including a box connection 14 for coupling to the end of a string (not shown).

The tool 10 comprises a number of primary element which will be described in detail in due course, these being a power section or motor 16, a valve 18, a drive piston 20, a reciprocating mass 22 and a bit 24. In operation, drilling fluid is pumped through the tool, the fluid passing through the motor 16 and thus driving the valve 18. The operation of the valve 18 controls the flow of drilling fluid to the drive piston 20. If the tool 10 is configured such that the hammer function is active, the piston 20 is reciprocated by the drilling fluid and the mass 22, which is coupled to the piston 20, impacts on the bit 24.

The various elements of the tool 10 will now be described in more detail. In this embodiment the motor 16 is a Moineau principle positive displacement motor with the stator 26 formed in an elongate housing 28 mounted to the sub 12. The lobed rotor 30 extends through the stator 26 and rotates and oscillates transversely as drilling fluid is pumped through the motor 16.

Figure 2:
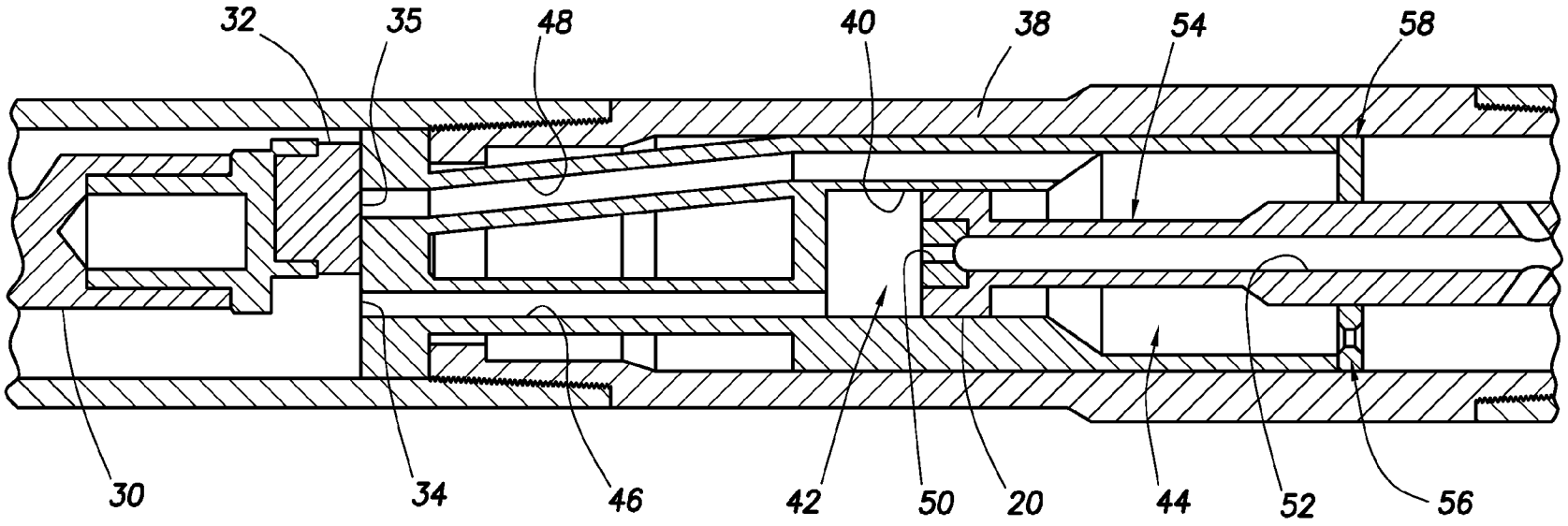
FIGS. 2, 3 and 4 are sectional views of the valve and drive piston of the tool of FIG. 1.

A valve plate 32 is mounted on the lower end of the rotor 30, as is more clearly illustrated in FIG. 2 of the drawings. As the rotor 30 oscillates the valve plate 32 covers and uncovers ports 34, 35 which provide for communication of the drilling fluid with the drive piston 20.

As illustrated in FIG. 2, the piston 20 is accommodated within a sub 38 within which is defined a cylinder 40 having an upper chamber and a lower chamber 42, 44. A power conduit 46 provides fluid communication between the valve port 34 and the upper chamber 42, while a return conduit 48 provides fluid communication between the valve port 35 and the lower chamber 44. Exhaust from the upper chamber 42 is provided by an exhaust nozzle 50 which communicates with an exhaust conduit 52 extending through a piston rod 54 which couples the piston 20 to the reciprocating mass 22. An exhaust nozzle 56 for the lower chamber 44 is formed in a lower cylinder end cap 58.

Figure 3:
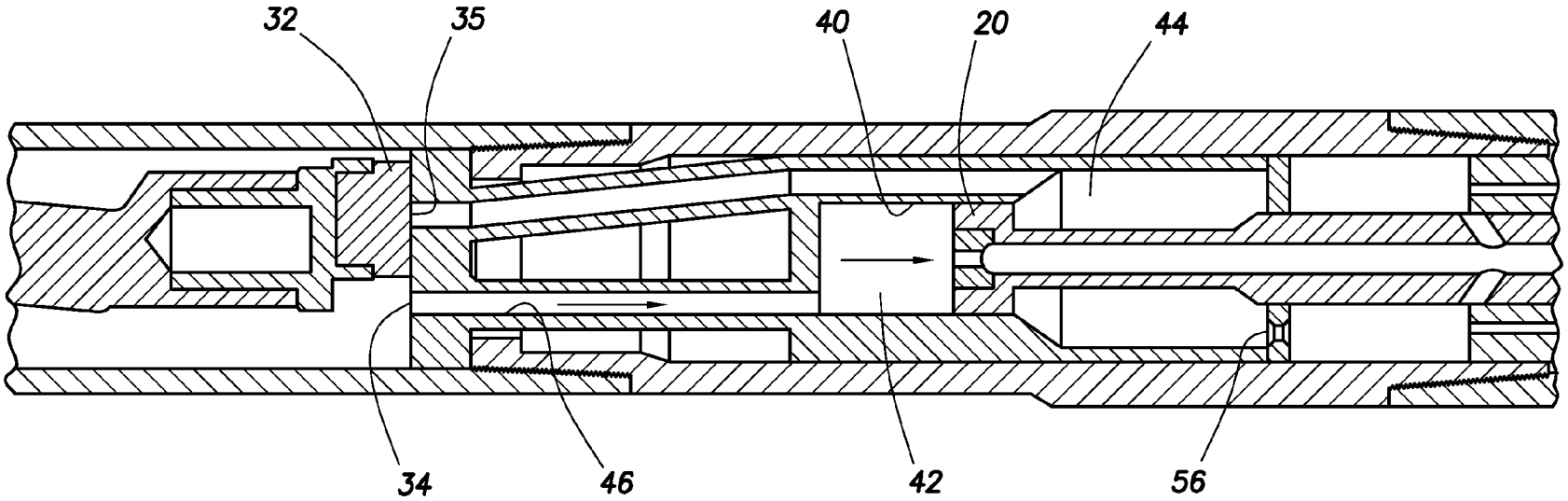
Figure 4:
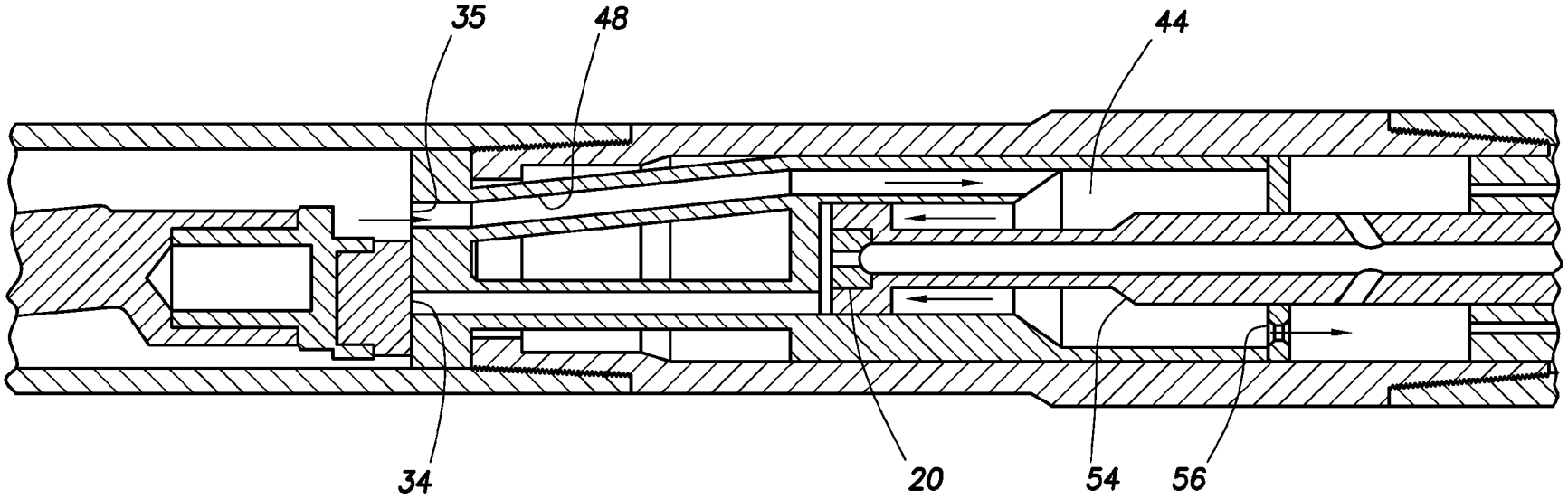
Figure 5:
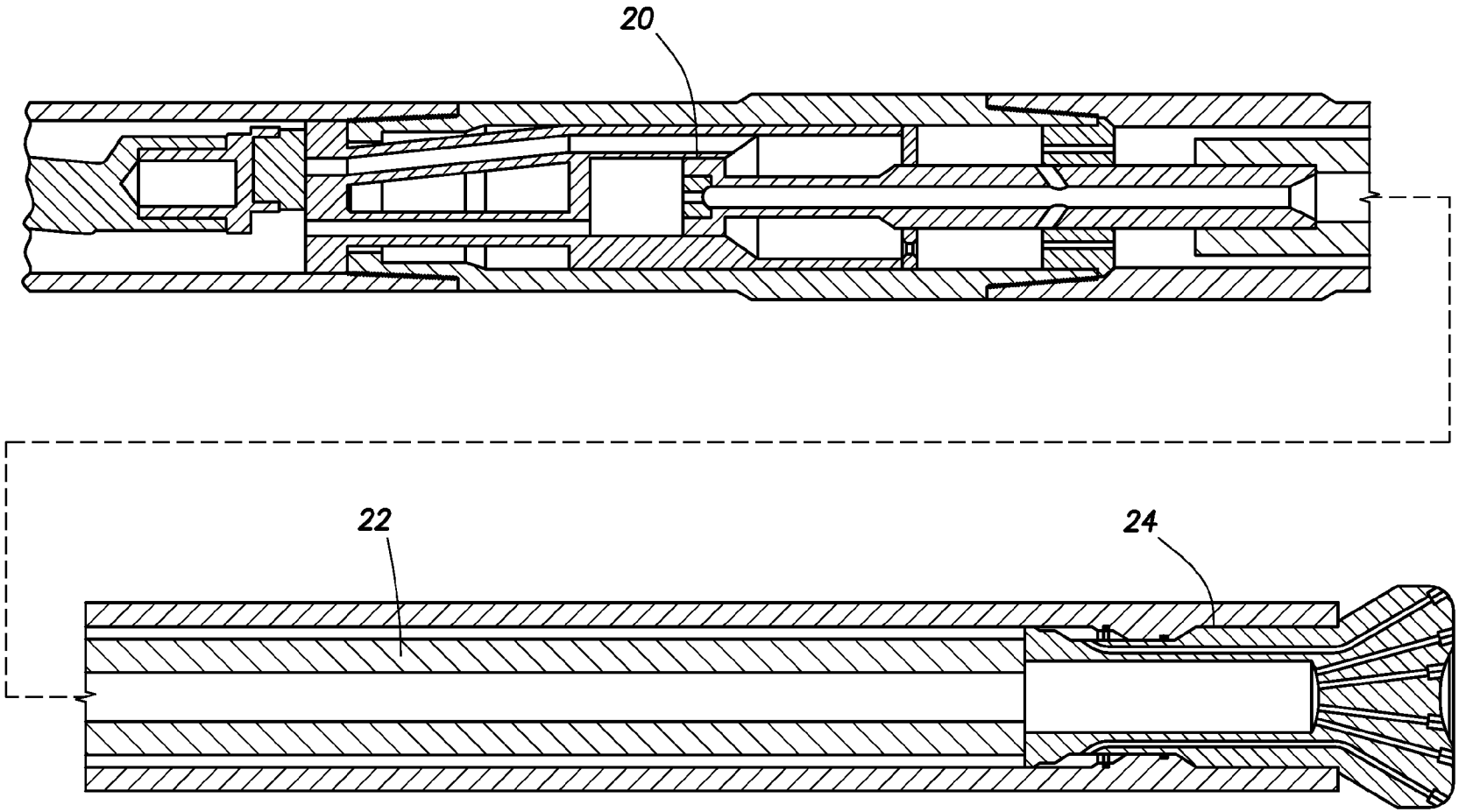
FIGS. 5 and 6 are sectional views of the lower portion of the tool of FIG. 1 with the hammer activated.

Reference is now also made to FIGS. 3 and 4 of the drawings, which illustrate the operation of the piston 20 when the hammer is activated. As noted above, as drilling fluid is pumped through the tool 10, the motor 16 will operate to move the valve plate 32 and cover and uncover the ports 34, 35. FIG. 3 illustrates the valve plate 32 closing the return port 35, such that drilling fluid flows through the power port 34 and the power conduit 46, into the upper chamber 42. The fluid pressure differential across the piston 20 pushes the piston 20, and thus also the mass 22, downwards such that the lower end of the mass 22 impacts on the upper face of the drill bit 24, as illustrated in FIG. 5 of the drawings. The movement of the mass 22, and thus the stroke of the piston 20, is limited by the bit 24. As the piston 20 moves down through the cylinder 40, fluid is displaced from the lower chamber 44 through the lower exhaust nozzle 56. There will also be leakage of fluid from the upper chamber 42 through the exhaust nozzle 50, however this leakage will be relatively insignificant compared to the flow of fluid into the chamber 42.

Figure 6:
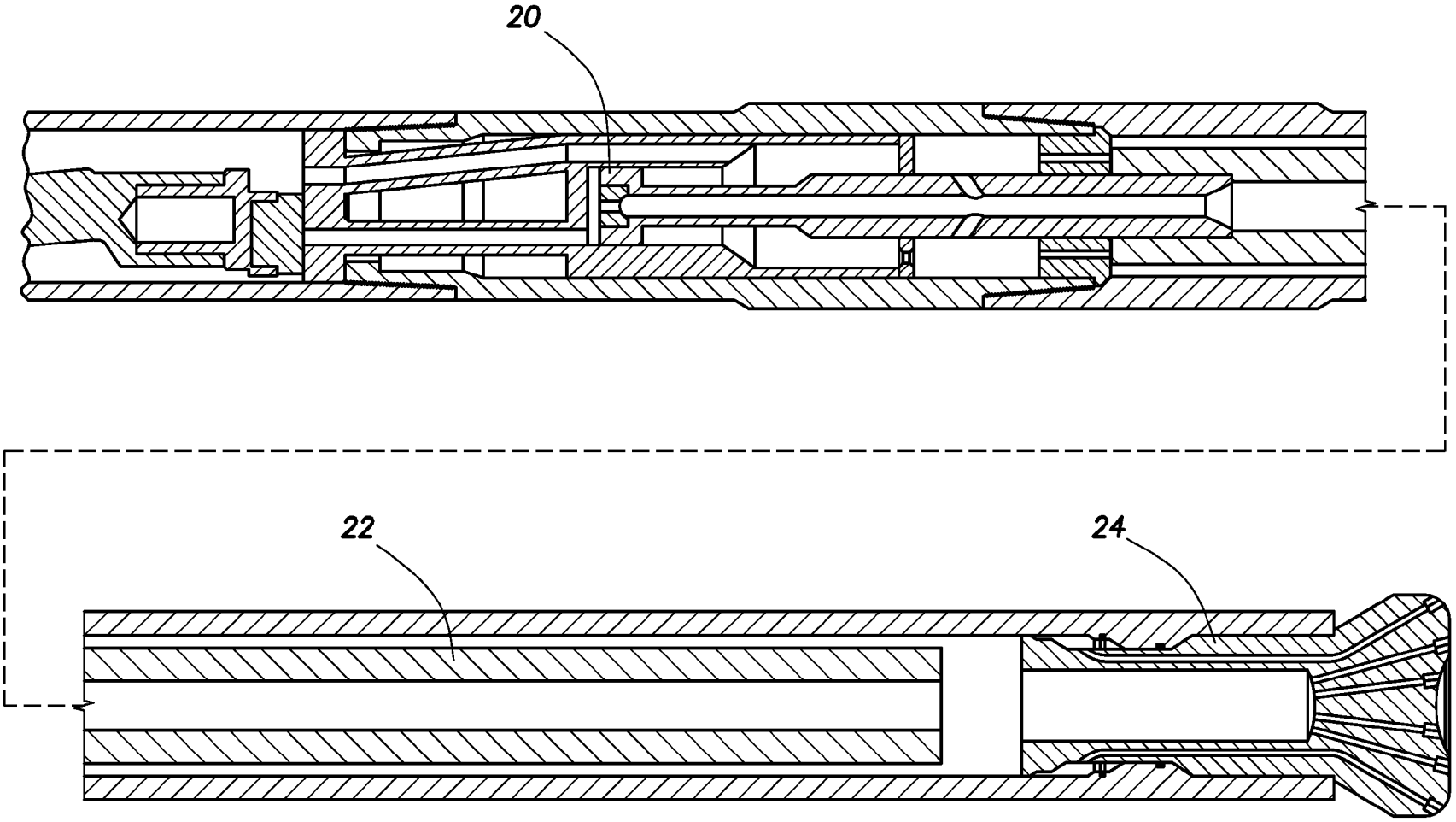

As the valve plate 32 then moves to close the power port 34 and uncovers the return port 35, drilling fluid is then supplied, though the port 35 and the return conduit 48, to the lower chamber 44, as illustrated in FIG. 4. The pressure differential across the piston 20 then forces the piston 20, and thus also the mass 22, upwards, as is also illustrated in FIG. 6 of the drawings. As the piston 20 moves upwards through the cylinder 40 fluid is displaced from the upper chamber 42 through the exhaust nozzle 50 formed in the piston 20. As the function of the return stroke of the piston 20 is only to return the piston 20 and mass 22 to an upper position, the piston 20 and cylinder 40 are configured such that there is significantly less force acting on the piston 20 during the return stroke. This is achieved through a number of measures, one being the provision of a relatively unrestricted lower exhaust nozzle 56, allowing leakage though the nozzle 56. Also, the piston rod 54 reduces the piston area exposed to actuating fluid pressure, and the piston rod 54 is of greater diameter where it extends through the cylinder end cap 58. Thus, the differential piston area experiencing return pressure is relatively small, thereby avoiding the piston 20 impacting against the upper wall of the chamber 42 at the end of the return stroke.

As noted above, the length of the power stroke of the piston 20 is limited by the lower end of the mass 22 impacting on the upper end of the bit 24, as illustrated in FIG. 5. As will be described below, the drill bit 24 may be reconfigured to permit further movement of the piston 20 and mass 22 and thus deactivate the hammer.

Figure 7:
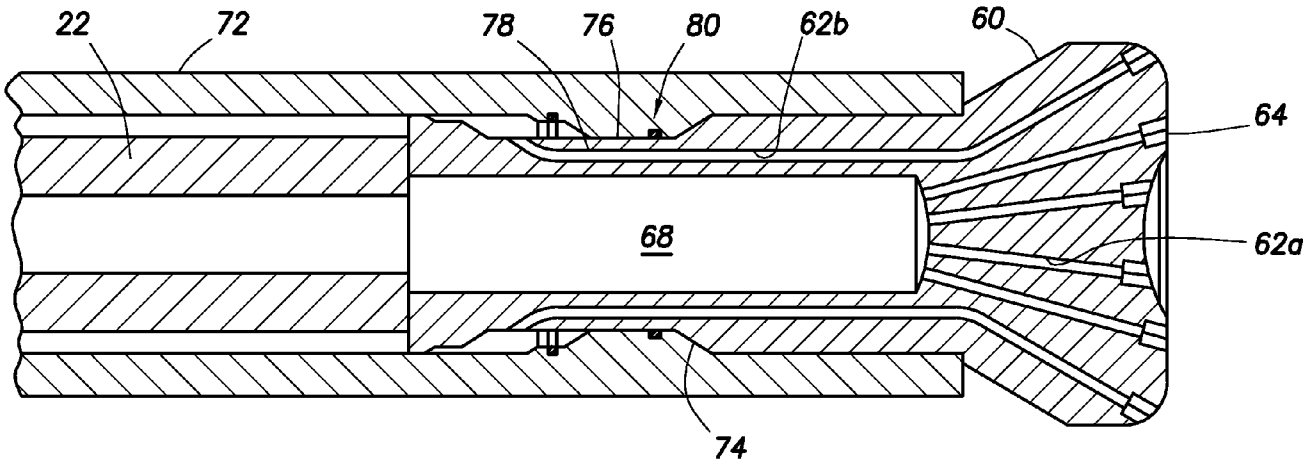
FIGS. 7 and 8 are sectional views of the drill bit of the tool of FIG. 1.
Figure 8:
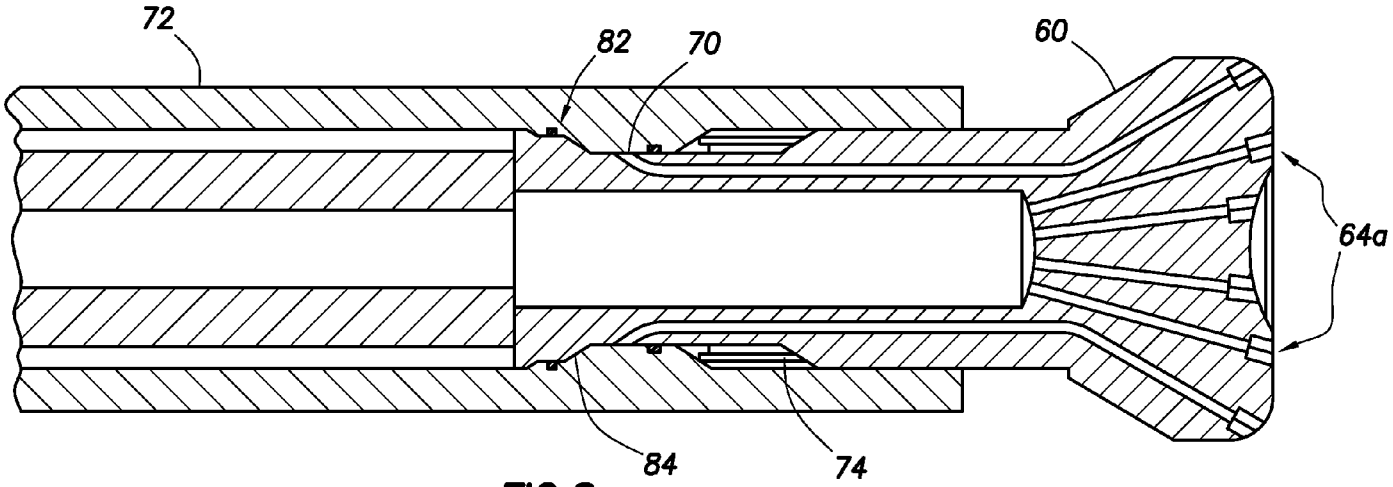

Reference is now also made to FIG. 7 of the drawings, which shows the bit in the hammer activated configuration. The bit 24 includes a bit element 60 which is moveable between a retracted position, as illustrated in FIG. 7, and an extended position, as illustrated in FIG. 8 of the drawings. When the bit element 60 is in the retracted position the hammer is activated, and when the bit element 60 is extended, the hammer is deactivated.

The bit element 60 defines a number of flow conduits 62 which provide communication with jetting nozzles 64 in the bit element 60. A group of central flow conduits 62*a* (four shown in the Figures) communicate with a central bore or manifold 68 which extends from the proximal end of the bit element 60. An outer group of flow conduits 62*b* (two shown in the Figures) extend from inlet ports 70 on side surfaces of the element 60.

The bit element 60 is coupled to a sub 72, which also accommodates the mass 22, by splines 74 which permit a degree of axial movement of the element 60 relative to the sub 72, but which permit transfer of rotation from the sub 72, and thus the drill string, to the bit element 60. Above the splines 74, the sub 72 forms a shoulder 76 which cooperates with a necked portion of the element 78. A seal 80 on the shoulder 76 engages with the necked portion 78. With the bit element 60 retracted the inlet ports 70 to the flow conduit 62*b* are located above the shoulder 76, providing a flow path for drilling fluid which has passed down through the tool 10. When the bit element 60 is in the extended position, as illustrated in FIG. 8, a larger diameter seal 82 provided on the sub 72 above the shoulder 76 engages with larger diameter bit element shoulder 84 and isolates the inlet ports 70, such that fluid may only exit the bit through the central group of jetting nozzles 64*a*. The Figures identify the seal 82 as an elastomer seal, however in practice it is more likely that the seal will be formed of hard metal, as an elastomer seal may be vulnerable to washing out and some degree of leakage past the seal would be acceptable.

Figure 9:
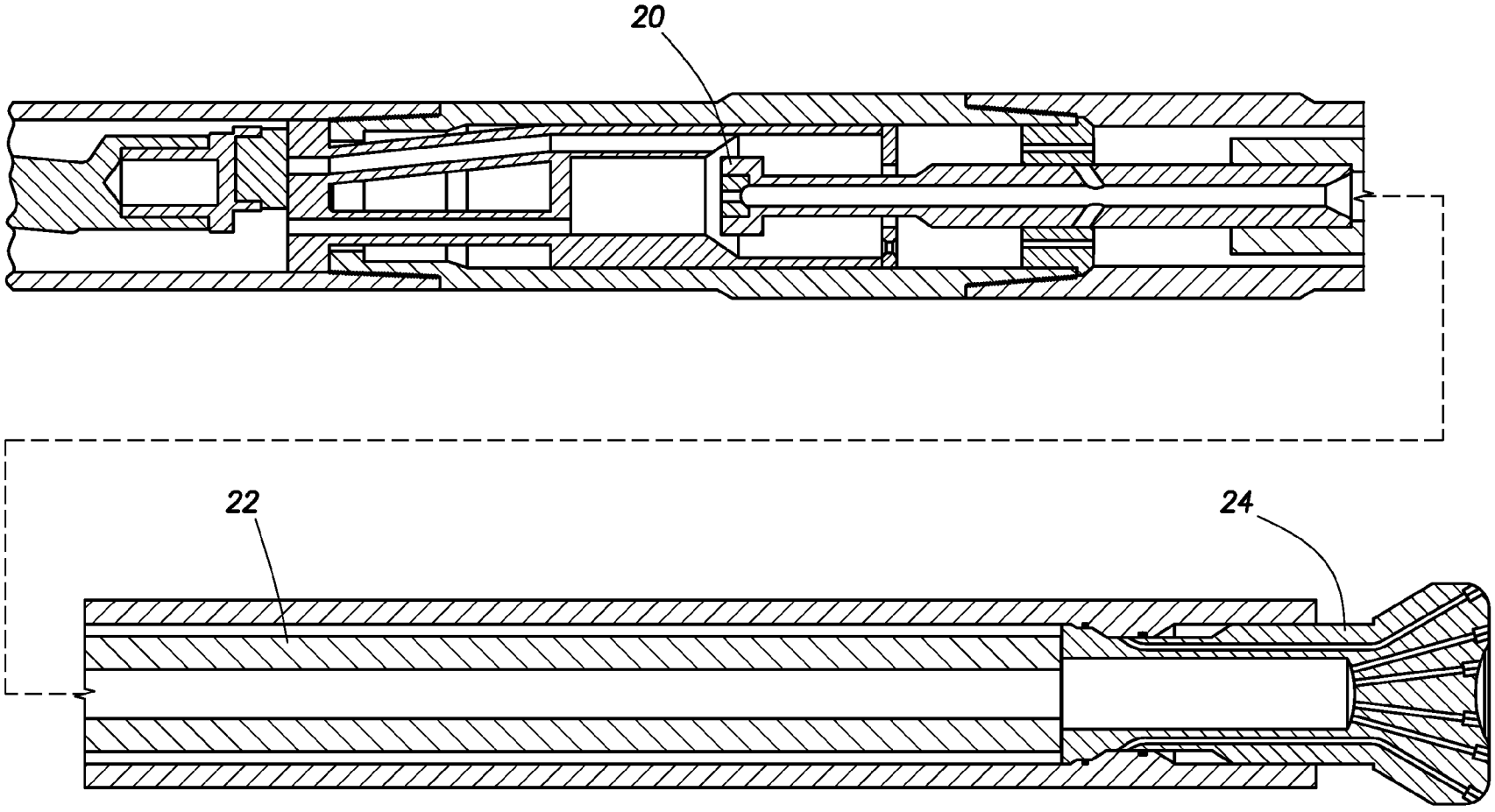
FIG. 9 is a sectional view of the lower portion of the tool of FIG. 1 with the hammer deactivated.
Figure 10:
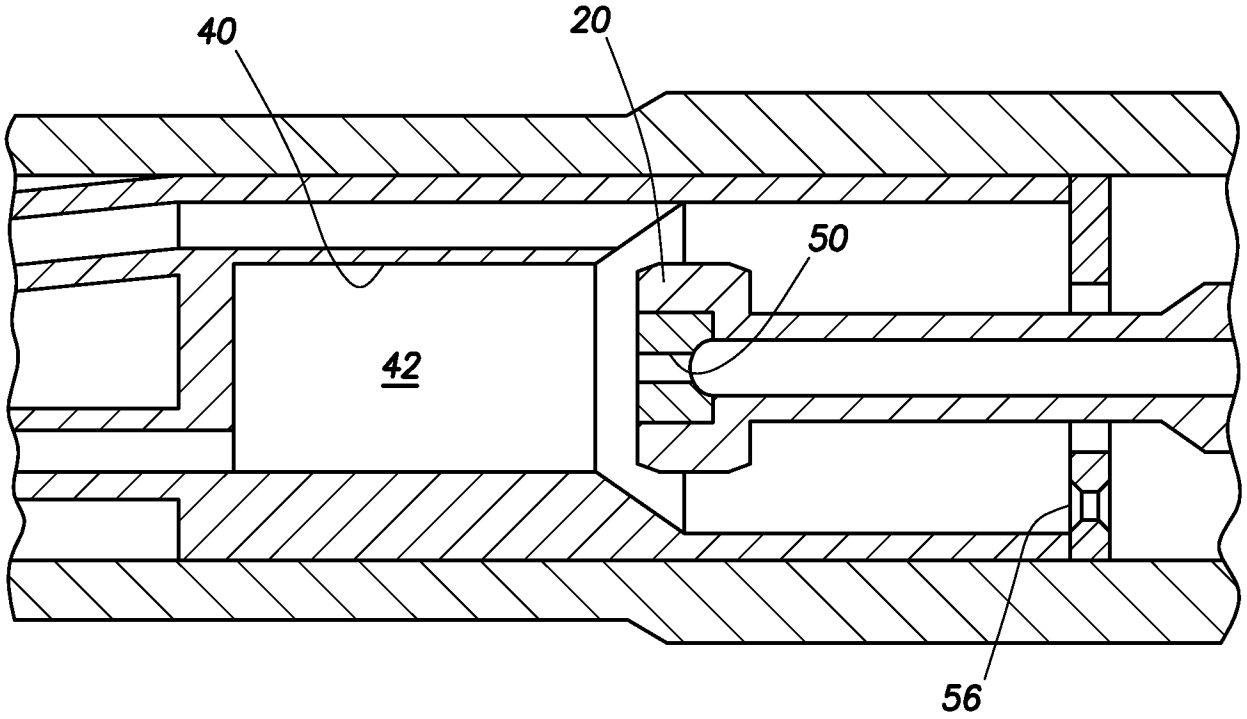
FIG. 10 is a sectional view of the drive piston of the tool when configured as shown in FIG. 9.

When the bit element 60 is permitted to move to the extended position, as illustrated in FIG. 8, the mass 22 and thus the piston 20 may move downwards in the cylinder 40. Thus, the piston 20 drops into the larger diameter portion of the lower chamber 44, such that an annular flow path is provided around the piston 20. Also, a necked portion of the piston rod 54 is then located in the end cap 56, providing a further flow path from the cylinder 40. This tool configuration is illustrated in FIGS. 9 and 10 of the drawings. With the piston 20 in this position, the motor 16 and valve 18 will continue to operate, however the drilling fluid will simply pass though the cylinder 40 without effecting any movement of the piston 20.

In operation, while drilling through relatively soft formations, the hammer will be deactivated and the bit element 60 will be in the extended position. As noted above, in this configuration the outer flow conduit 62*b* are closed off thus reducing the total flow area (TFA) of the bit 24 and restricting the flow to the central flow conduits 62*a*. Bit pressure will act across the area defined by the larger seal 82. Thus, with the tool in this configuration there is a significant pressure drop at the bit 24, this higher hydraulic horse power being useful to ensure adequate bit tooth and bottom-of-hole cleaning.

If a hard formation is encountered the drilling fluid pumps are switched off or the drilling fluid flow reduced, and weight on bit (WOB) applied, allowing the bit element 60 to retract. As noted above, in the retracted position, the inlet ports 70 are exposed, increasing the bit TFA and reducing bit pressure, this reduced bit pressure also acting across the smaller area defined by the seal 80. Once the bit element 60 has been retracted, the drilling fluid flow is then increased and the hammer will start to operate, due to the piston 20 having been pushed back into the upper part of the cylinder 40. The pressure drop and horse power per square inch (HSI) at the bit is substantially reduced compared to the extended bit element position, however this does not present a problem as there is very little requirement for high HSI when drilling hard rock. The total pressure drop across the tool 10 would comprise the pressure drop across the valve and piston arrangements plus the bit pressure. Hammer drilling would then proceed and providing the weight on bit is not reduced below the bit element extending force the tool will maintain the hammer active configuration.

If a softer formation is encountered the drilling fluid pumps would be brought up to full flow rate before lifting the drill bit off bottom. This allows the bit element 60 to move to the extended position, such that the mass 22 and piston 20 move downwards and the hammer action is deactivated. The TFA of the bit 24 is reduced so that the pressure drop and extending force experienced by the bit increase significantly. Also, the bit pressure is now acting across the larger area defined by the seal 80, further increasing the extending force. The bit HIS has now been increased for the softer formation where it will be most effective. Provided the hydraulic extending force is not exceeded by the weight on bit the tool will remain in this configuration, with the hammer inactive. As noted above, with the piston inactive there are minimal pressure losses due to the piston arrangement and therefore the total pressure drop is accounted for primarily by the bit pressure.

This may be demonstrated with reference to a tool having an outside diameter of 6¾" as would be utilized to drill an 8½" (17.14 cm) diameter hole. With the bit element extended and the hammer deactivated the bit TFA is reduced, and the pressure across the bit increased and effective across the larger area defined by the upper seal 82. Assuming a bit pressure of 1,100 psi (77.36 kg/cm) and a seal diameter of 5" (12.70 cm) (seal area 19.64 sq. in. (49.89 cm)) then the bit element extending, or "pump open" force will be 1,100×19.64=21,604 lbs (9799.40 kg). The total pressure drop across the tool 10 is 1,100 psi (77.36 kg/cm). The tool 10 will remain in this configuration unless the WOB exceeds 21,604 lbs (9799.40 kg).

With the bit element retracted and the hammer activated the bit TFA is increased and the pressure across the bit reduced and now acting across the smaller area defined by the lower seal 80. With a bit pressure of 100 psi (7.03 kg/cm) and a seal diameter of 4" (10.16 cm) (seal area 12.57 sq. in. (31.93 cm)) then the bit extending "pump open" force will be 100×12.57 lbs (31.93 cm). Because the hammer requires 1,000 psi when activated the total pressure drop will be 1,000+100=1,100 psi (77.36 kg/cm). The tool 10 will thus remain in this configuration unless the WOB drops below 1,257 lbs (570.17 kg).

As is apparent from this example, due to the change in hydraulic profile of the bit achieved by moving the bit element between the extended and retracted positions the total pressure drop across the tool in either position is substantially identical, such that there is no requirement to change stand pipe pressure between the hammer activated and hammer deactivated configurations.

Those of skill in the art will recognise that the above described embodiment is merely exemplary of the present invention, and that various modifications and improvements may be made thereto, without departing from the scope of the present invention. For example, in other embodiments roller cone bits may be used rather than the PDC bits as illustrated. Further, in other embodiments the flow conduits 62*b* may be replaced or supplemented with flow conduits through the housing or sub 72.

The above embodiment describes a reconfigurable bit which is utilized to activate and deactivate a hammer mechanism acting on the bit. In other embodiments the bit could be utilized to control a different device or tool, which device might operate independently of the bit, and need not be positioned adjacent the bit, or indeed be located in the BHA. The control of the device could be effected by the axial movement of the bit, translated to axial movement of an element of the device, or the control of the device may rely on the variable back-pressure provided by the different bit configurations.

The bit as described herein may also have independent utility, that is the bit need not be utilized to control another tool or device provided in the BHA. For example, the different bit configurations may be utilized simply to vary the flow of drilling fluid from the bit or to vary the hydraulics of the drill string and thus facilitate control of the circulation of drilling fluid in the bore.

The principles utilized in the bit as described above could also be utilized in device or tools other than a bit, and in other forms of tubing strings, such as casing strings or completions. For example, the bit may be replaced by a device such as a shoe, probe or profile adapted to engage the end of a bore, a plug, or a matching profile or no-go defined by bore-lining tubing. By manipulation of fluid pressure and applied weight the device may be reconfigured to control another tool or device, or to vary the hydraulics of the string.

What is claimed is:

1. A method of operating a downhole tool, the method comprising:

operating a motor-driven valve to control a supply of actuating fluid to a piston associated with a reciprocating mass by selectively diverting the actuating fluid between a first inlet port to an upper face of the piston and a second inlet port to a lower face of the piston, the first and second ports being located uphole of the piston;

arranging the piston in an inactive configuration; and arranging the piston in an active configuration to reciprocate the mass.

2. The method of claim 1, further comprising reconfiguring the tool and reciprocating the mass.

3. The method of claim 2, wherein the reciprocating of the mass occurs when the downhole tool is in the active configuration and wherein the reciprocating comprises cycling the motor-driven valve between a first configuration in which actuating fluid pressure drives the piston associated with the mass downwards and a second configuration in which the actuating fluid pressure drives the piston upwards.

4. The method of claim 1, further comprising reconfiguring the tool to the inactive configuration when it is desired to prevent reciprocation of the mass.

5. The method of claim 1, wherein reciprocating the mass provides one of agitation of the tool and a hammer effect on a drill bit.

6. The downhole tool of claim 1, wherein the first port and the second port extend through a wall separating the housing into a valve chamber and a piston chamber, the motor-drive valve positionable in the valve chamber adjacent the wall and the piston positioned in the piston chamber.

7. A downhole tool comprising:

a fluid actuated piston operatively associated with a reciprocating mass, the piston having active and inactive configurations; and a motor-driven valve for controlling a supply of actuating fluid to the piston, the motor-driven valve comprising a valve plate rotationally positionable to selectively divert the actuating fluid between a first inlet port to an upper face of the piston and a second inlet port to a lower face of the piston to selectively apply the supply of the actuating fluid about the piston.

8. The downhole tool of claim 7, wherein the piston is controlled remotely from surface.

9. The downhole tool of claim 7, wherein the piston is controlled, at least in part, by manipulation of fluid pressure.

10. The downhole tool of claim 7, wherein the piston is controlled, at least in part, by mechanical forces applied to the downhole tool.

11. The downhole tool of claim 7, wherein the downhole tool defines a cylinder for accommodating the piston.

12. The downhole tool of claim 11, wherein the configuration of the piston is determined by a relative positioning of the piston and one of the cylinder and a cylinder element.

13. The downhole tool of claim 11, wherein the cylinder includes an upper and a lower chamber such that when the actuating fluid is directed to the upper chamber, the piston is urged downwards, and when the actuating fluid is directed into the lower chamber, the piston is urged upwards, when the piston is in the active configuration.

14. The downhole tool of claim 13, wherein at least one of the chambers has at least one exhaust port, each of the at least one exhaust ports to restrict flow therethrough.

15. The downhole tool of claim 14, wherein at least one of the at least one inlet ports is in fluid communication with the motor-driven valve.

16. The downhole tool of claim 15, wherein the downhole tool is configured such that communicating an actuating fluid pressure with the upper face of the piston produces a greater force on the piston than communicating a corresponding actuating fluid pressure with the lower face of the piston.

17. The downhole tool of claim 16, wherein the piston is mounted on a piston shaft, and the piston shaft is coupled to the reciprocating mass.

18. The downhole tool of claim 17, wherein the piston shaft extends through the lower chamber and reduces an area of the piston exposed to the actuating fluid pressure in the lower chamber.

19. The downhole tool of claim 18, wherein the lower chamber has one of the at least one exhaust ports and the upper chamber has another of the at least one exhaust ports, the one being less restrictive than the another of the at least one exhaust ports.

20. The downhole tool of claim 7, wherein in the active configuration the piston reciprocates between upper and lower positions and cooperates with fluid inlets and outlets in such a manner to maintain the reciprocation.

21. The downhole tool of claim 7, wherein in the inactive configuration the piston is located such that the actuating fluid bypasses the piston.

22. The downhole tool of claim 7, wherein the piston is coupled, directly or indirectly, to one of a cam and track.

23. The downhole tool of claim 7, wherein the piston is coupled to a bit axially movable along as longitudinal axis of the downhole tool.

24. The downhole tool of claim 23, wherein with the bit in one configuration, the piston is constrained to be in the active configuration and with the bit in another configuration, the piston is constrained to be in the inactive configuration.

25. The downhole tool of claim 24, wherein with the bit in a retracted configuration, the piston is in the active configuration, and with the bit in an extended configuration, the piston is in the inactive configuration.

26. The downhole tool of claim 25, wherein the hit is movable between different configurations by application of one of fluid pressure, weight, and combinations thereof.

27. The downhole tool of claim 7, further comprising:

a body to accommodate the piston and the motor-driven valve;

wherein the motor-driven valve is for supplying the actuating fluid sequentially to drive the piston downwards and upwards when the piston is in the active configuration.

28. The downhole tool of claim 27, wherein, when the piston is in the active configuration, the motor-driven valve cycles between:

a first configuration in which the actuating fluid pressure drives the piston downwards; and a second configuration in which the actuating fluid pressure drives the piston upwards.

29. The downhole tool of claim 27, wherein the piston is linked to the reciprocating mass such that the actuating fluid moves the mass downwards, when the piston is in the active configuration.

30. The downhole tool of claim 27, wherein the piston is linked to the reciprocating mass such that the actuating fluid moves the mass upwards, when the piston is in the active configuration.

31. The downhole tool of claim 27, wherein the downhole tool is a reciprocating mass percussion tool.

32. The downhole tool of claim 27, wherein the mass is adapted to be operatively associated with a drill bit or other cutting structure.

33. The downhole tool of claim 27, wherein the mass is operable to provide a hammer-drilling effect, when the piston is in the active configuration.

34. The downhole tool of claim 27, wherein the downhole tool is configured such that at least one piston stroke is damped, at least towards the end of the at least one stroke.

35. The downhole tool of claim 27, wherein the motor-driven valve comprises valve members which cooperate to open and close valve ports.

36. The downhole tool of claim 35, wherein the valve members are movable.

37. The downhole tool of claim 27, wherein the motor-driven valve is driven by a positive displacement motor.

38. The downhole tool of claim 37, wherein the positive displacement motor is a Moineau principle motor.

39. A hydraulically-actuated reciprocating mass percussion drilling tool, comprising:

a percussion portion having a reciprocating mass and a fluid-actuated piston associated with the mass;

a motor-driven valve for controlling a supply of actuating fluid to the piston, the motor-driven valve comprising a valve plate rotationally positionable to selectively divert the actuating fluid between a first inlet port to an upper face of the piston and a second inlet port to a lower face of the piston; and a drill bit associated with the mass, the drilling tool having a first configuration in which the percussion portion is operative and a second configuration in which the percussion portion is inoperative.

40. A drilling method comprising:

arranging a drilling tool in a first configuration in which a percussion portion has a mass and a fluid-actuated piston associated with the mass is operative to reciprocate the mass by selectively diverting fluid through a first inlet port to an upper face of the piston and through a second inlet port to a lower face of the piston; and arranging the drilling tool in a second configuration in which the percussion portion is inoperative, the first and second inlet ports being located uphole of the piston.

41. The drilling method of claim 40, further comprising generating a first fluid pressure drop in the first configuration, and generating a lower second pressure drop in the second configuration.

42. The downhole tool of claim 27, wherein the downhole tool permits a passage of fluid through the drilling tool.

43. The downhole tool of claim 42, wherein the drilling tool continuously permits a passage of the fluid through the drilling tool.

44. The downhole tool of claim 27, wherein the body defines a throughbore.

45. The downhole tool of claim 27, wherein the downhole tool prevents uphole passage of the fluid through the body.

46. The downhole tool of claim 27, wherein the actuating fluid is a drilling fluid.

47. The downhole tool of claim 27, wherein the motor-driven valve comprises a rotatable member, the rotatable member rotating about a longitudinal axis of the downhole tool.

* * * * *